US006539880B2

(12) United States Patent
Simms

(10) Patent No.: US 6,539,880 B2
(45) Date of Patent: Apr. 1, 2003

(54) CORRUGATED PAPERBOARD PALLET RAIL

(76) Inventor: Walter Brian Simms, P.O. Box 2365, Rome, GA (US) 30163

( * ) Notice: Subject to any disclaimer, the term of this patent is extended or adjusted under 35 U.S.C. 154(b) by 0 days.

(21) Appl. No.: 09/892,602

(22) Filed: Jun. 27, 2001

(65) Prior Publication Data

US 2002/0088378 A1 Jul. 11, 2002

Related U.S. Application Data

(60) Provisional application No. 60/260,157, filed on Jan. 8, 2001, and provisional application No. 60/279,084, filed on Mar. 27, 2001.

(51) Int. Cl.[7] ..... B65D 19/00
(52) U.S. Cl. ..... 108/51.3
(58) Field of Search ..... 108/51.3, 51.11, 108/56.3

(56) References Cited

U.S. PATENT DOCUMENTS 2,728,545 A * 12/1955 Hermitage
4,102,525 A * 7/1978 Albano
4,792,325 A * 12/1988 Schmidtke
5,001,991 A * 3/1991 Smith
5,483,875 A * 1/1996 Turecek et al.
5,503,085 A * 4/1996 Rozek
5,660,119 A * 8/1997 Perkins

FOREIGN PATENT DOCUMENTS

JP 6-56154 * 3/1994

* cited by examiner

*Primary Examiner*—Jose V. Chen
(74) *Attorney, Agent, or Firm*—Gardner Groff & Mehrman, P.C.

(57) ABSTRACT

A sheet of corrugated paperboard formed into eleven panels, with a central panel, two end panels, and eight intermediate panels, that are interconnected at fold lines so that the sheet can be folded to form a rail for withstanding a load. The sheet can be folded to form a rail with only six vertical support panels and two diagonal support panels, only two folds against the prevailing fold direction, and only three glue areas. Also, the sheet has openings that, when the sheet is folded into the rail, align to form channels for receiving forklift arms.

20 Claims, 6 Drawing Sheets

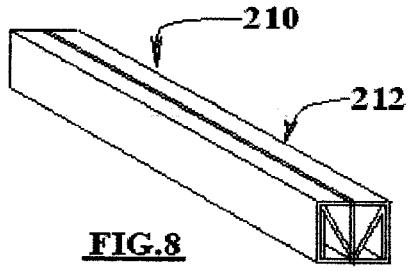
FIG.8
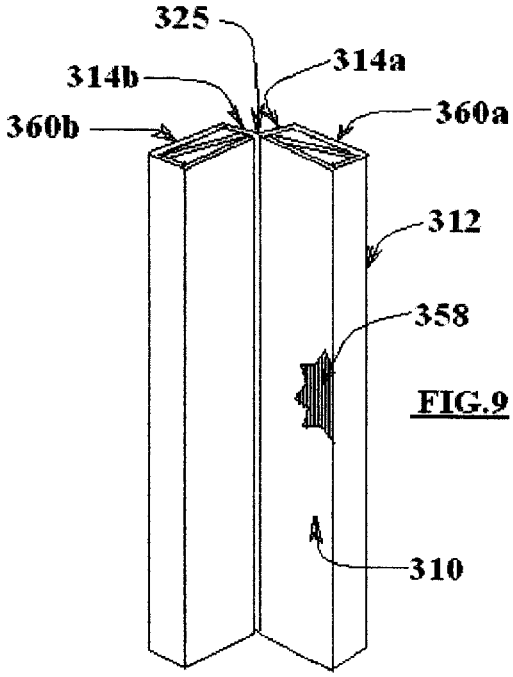
FIG.9
FIG.10
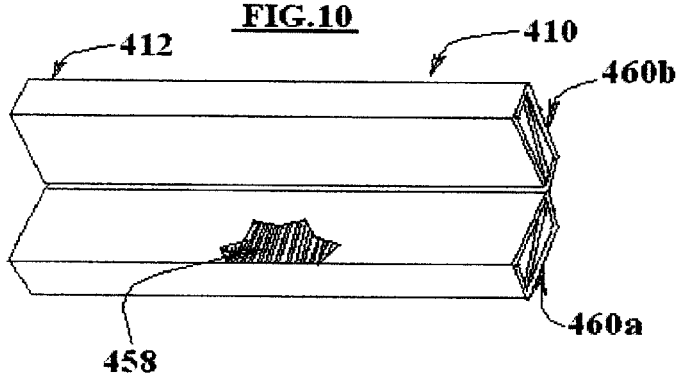

CORRUGATED PAPERBOARD PALLET RAIL

CROSS REFERENCE TO RELATED APPLICATIONS

This application claims the priority benefit of U.S. Provisional Patent Application No. 60/279,084, filed on Mar. 27, 2001, and U.S. Provisional Patent Application No. 60/260,157, filed on Jan. 8, 2001, both of which are hereby incorporated herein by reference.

TECHNICAL FIELD

The present invention relates generally to pallets for storing and moving items and, in particular, to a support rail for a pallet that is formed from a folded sheet of corrugated paperboard.

BACKGROUND OF THE INVENTION

Pallets and other platforms for storing and carrying loads are well known in the art. Traditionally, pallets have been made of wood and sometimes metal. More recently, pallets have been made of corrugated paperboard. Such pallets have several advantages, for example, they typically cost and weight less than wood, and they can be readily recycled at the end of their useful lives. However, corrugated paperboard pallets have their drawbacks, for example, they are generally not sufficiently strong or durable to be used in many of the applications where wood pallets are used.

There are several known corrugated paperboard pallets that attempt to overcome these deficiencies. For example, U.S. Pat. No. 4,563,377 to Melli discloses a pallet made of tubular beams each formed by a sheet having number of cardboard panels folded over on themselves. Because of the relatively large number of panels per sheet, these beams provide for a substantially increased strength relative to hollow cardboard beams.

However, this beam configuration has a number of disadvantages, including that each beam has two exposed corrugated sheet ends at the top center portion of the beam. The sheet ends expose the open corrugated flutes of the interior of the paperboard to moisture and other debris, the intrusion of which tends to weaken and reduce the useful life of the beam. Also, the beam has eight inward folds and six outward folds. With so many folds against each other, this beam would be extremely hard to fold, so the use of some heavier gauge cardboard sheets may not be practical. In order to still accomplish the needed strength, the relatively large number of panels (fifteen) is provided, which results in a large number of folding steps (fourteen) and gluing steps (seven glue areas total per beam).

A similar pallet beam is disclosed by U.S. Pat. No. 5,423,270 to Kilpatrick et al. This beam or stringer suffers from similar deficiencies due to the relatively large number of panels (thirteen), folding steps (twelve), and glue steps (five) per beam, without appreciably increasing the strength of the resulting beam.

Additional corrugated paperboard pallets and beams are disclosed by U.S. Pat. No. 5,285,731 to McIntyre and U.S. Pat. No. 5,377,600 to Speese et al. The beams of each of these patents have openings extending laterally through them for receiving the arms of a forklift. These beam arrangements make the pallets much easier to use in most warehouse applications where a forklift is used. However, the lateral openings through the beams significantly reduce the strength of the beams. Therefore, additional reinforcing members, complex cutting and folding of support flaps, and/or thicker top pallet members are required, thereby increasing the material and manufacturing costs of the pallets.

Accordingly, it can be seen that none of these pallets has proven entirely satisfactory. Therefore, a need yet remains for a corrugated paperboard pallet rail that is strong and durable, but lightweight and inexpensive to manufacture. It is to the provision of such an article that the present invention is primarily directed.

SUMMARY OF THE INVENTION

Briefly described, the present invention comprises a sheet of corrugated paperboard that is formed into eleven panels, including a central panel, two end panels, and eight intermediate panels, all interconnected together at fold lines so that the sheet can be folded to form a rail for withstanding a load. The sheet can be folded to form a rail with only six vertical support panels and two diagonal support panels, only two folds against the prevailing fold direction, and only three glue areas, so that a heavy gauge material can be used to provide the strength needed for paperboard pallets. The rail formed thereby is useful to withstand loads applied by items placed on a pallet that includes the rails, by lateral impacts to cartons including such rails, by vertical loads on cartons including the rails, or otherwise.

In a first exemplary embodiment, the rail has two transverse channels and two support portions each formed by a set of openings in the sheet that are aligned when the sheet is folded to form the rail. The openings include a central opening in the central panel and the two adjacent intermediate panels, two intermediate openings in two other of the intermediate panels, and two end openings in the end panels. In this manner, the channels can be sized and shaped to receive an arm of a forklift rendering the rail well-suited for use in a pallet.

In a second exemplary embodiment, the rail has three transverse channels with a semi-circular shape. In this manner, the rail can be used in packaging and/or storage applications to support three items with a similar shape to prevent damaging them from accidental dropping or rolling. Alternatively, another number and shape of channels can be provided. In a third exemplary embodiment, the rail does not have any channels, and is best suited for applications requiring the highest strength.

In fourth and fifth exemplary embodiments, the rail has an additional fold line enabling the panels to be folded into two rail sections angled from each other, for use as corner rails in cartons or other packaging. In the fourth embodiment, the rail has corrugated ribs in the longitudinal direction for higher compression strength, for use as a post to protect the contents of the carton when stacked. In the fifth embodiment, the rail has corrugated ribs in the transverse direction for absorbing side impacts and creating a buffer space within the carton. In the sixth embodiment, the rail does not include the end panels, thereby providing the appropriate strength for low-load applications while reducing the material and assembly costs of the rail.

Accordingly, the present invention provides a corrugated paperboard pallet rail that is strong and durable, but lightweight and inexpensive to manufacture. The vertical and diagonal panels provide the strength needed without extra material, the folding directions of the panels permit the use of heavy gauge material, and the arrangement of the panels allows construction with only three glue areas for reduced assembly time and cost without sacrificing strength.

Additionally, the configuration of the openings in the sheet produce channels and support portions that provide increased strength and utility. These and other features and benefits will become more apparent from reading the following detailed description in conjunction with the appended drawing figures.

BRIEF DESCRIPTION OF THE DRAWINGS

FIG. 8 is a perspective view of a rail of a third exemplary embodiment of the present invention, showing the rail with no channels.

FIG. 9 is a perspective view of a rail of a fourth exemplary embodiment of the present invention, showing the rail with two angled rail sections configured for withstanding vertical compression loads.

FIG. 10 is a perspective view of a fifth exemplary embodiment of the present invention, showing the rail with two angled rail sections configured for withstanding lateral compression loads.

DETAILED DESCRIPTION OF EXEMPLARY EMBODIMENTS

Figure 1:
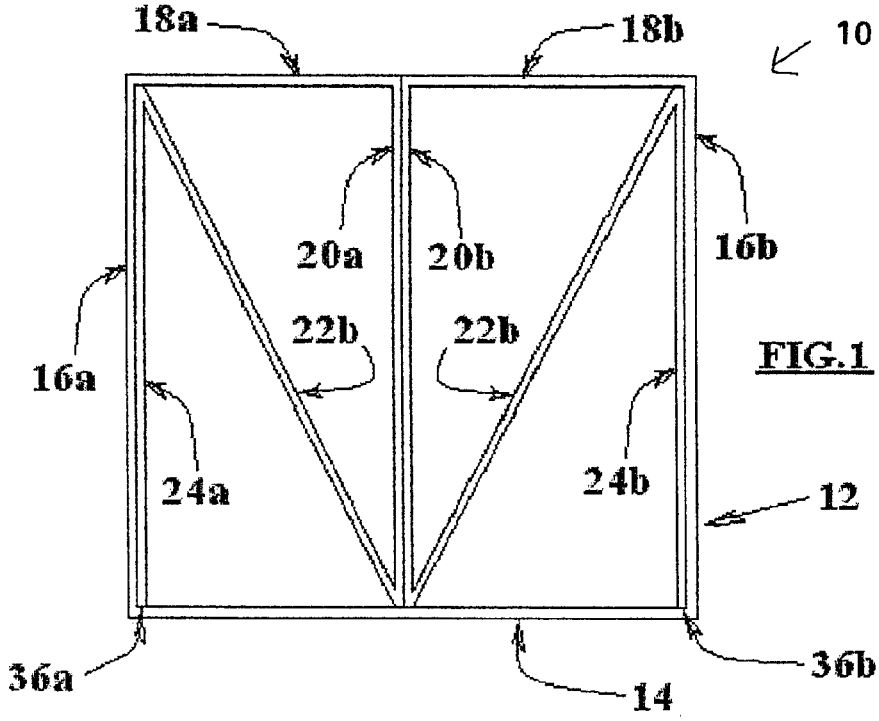
FIG. 1 is a sectional end view of a rail of a first exemplary embodiment of the present invention, showing a sheet folded to form the rail.

Referring now in detail to the drawing figures, wherein like reference numerals represent like parts throughout the several views, FIGS. 1–5 show a first exemplary embodiment of the present invention, referred to generally as the rail 10. The rail 10 is formed from a single sheet 12 of material such as corrugated paperboard blank. The paperboard can be selected with a gauge to provide the strength needed for withstanding an expected load a in particular application. Of course, other materials can be suitably used, such as metal, plastic, or composites.

Figure 2:
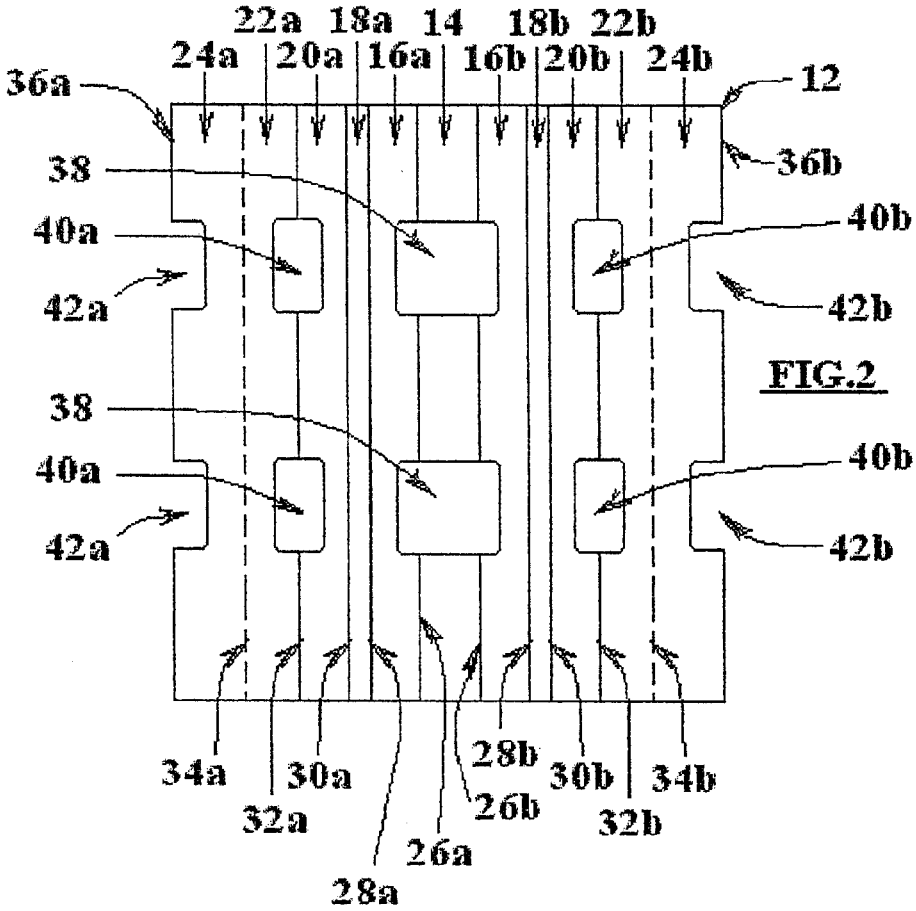
FIG. 2 is a top plan view of an unfolded blank from which the rail of FIG. 1 is formed, scored to define a plurality of panels connected by fold lines.

Referring to FIGS. 1 and 2, the sheet 12 has eleven panels connected together at fold lines, which permit the sheet shown in FIG. 2 to be folded into the rail 10 shown in FIG. 1. In particular, the sheet 12 has a central panel 14, two first intermediate panels 16*a* and 16*b*, two second intermediate panels 18*a* and 18*b*, two third intermediate panels 20*a* and 20*b*, two fourth intermediate panels 22*a* and 22*b*, and two end panels 24*a* and 24*b*. The first intermediate panels 16*a* and 16*b* are attached to the central panel 14 by inward fold lines 26*a* and 26*b*, the second intermediate panels 18*a* and 18*b* are attached to the first intermediate panels 16*a* and 16*b* by inward fold lines 28*a* and 28*b*, the third intermediate panels 20*a* and 20*b* are attached to the second intermediate panels 18*a* and 18*b* by inward fold lines 30*a* and 30*b*, the fourth intermediate panels 22*a* and 22*b* are attached to the third intermediate panels 20*a* and 20*b* by inward fold lines 32*a* and 32*b*, and the end panels 24*a* and 24*b* are attached to the fourth intermediate panels 22*a* and 22*b* by outward fold lines 34*a* and 34*b*. Additional or fewer panels and fold lines can be provided, if desired, but are not necessary.

Accordingly, the sheet 12 can be folded to form the rail 10 with the first intermediate panels 16*a* and 16*b* inwardly folded and extending generally perpendicularly from the central panel 14, the second intermediate panels 18*a* and 18*b* inwardly folded and extending generally perpendicularly from the first intermediate panels 16*a* and 16*b*, the third intermediate panels 20*a* and 20*b* inwardly folded and extending generally perpendicularly from the second intermediate panels 18*a* and 18*b*, the fourth intermediate panels 22*a* and 22*b* inwardly folded and extending diagonally from the third intermediate panels 20*a* and 20*b* toward fold lines 28*a* and 28*b* (connecting the first and second intermediate panels), and the end panels 24*a* and 24*b* outwardly folded and extending from the fourth intermediate panels 22*a* and 22*b* in parallel with and abutting against the first intermediate panels 16*a* and 16*b*. In this configuration, the first intermediate panels 16*a* and 16*b*, the third intermediate panels 20*a* and 20*b*, and the two end panels 24*a* and 24*b* are generally vertical, and the fourth intermediate panels 22*a* and 22*b* are diagonal, which results in a high strength rail 10. It will be understood that "generally vertical" as used herein includes up to about thirty degrees from vertical. Thus, for a rectangular or square rail, these panels are vertical, and for a trapezoidal rail, these panels are angled somewhat from vertical. None of the other panels are generally vertically or diagonally disposed. In this way, the rail 10 is very strong and can withstand significant loads, while having fewer panels and fewer folds than other known corrugated paperboard rails.

In this folded arrangement, the central panel 14, the first intermediate panels 16*a* and 16*b*, and the second intermediate panels 18*a* and 18*b* form a periphery and an inner space. Each of the end panels 24*a* and 24*b* has an open edge 36*a* and 36*b* that is within the inner space and that abuts a side of the central panel 14. In this way, the both open edges 36*a* and 36*b* of the blank or sheet 12 are not exposed but instead are covered, thereby preventing moisture and debris from entering the flutes of the corrugated paperboard sheet. Accordingly, the rail 10 tends to be less susceptible to deterioration from water and so forth, and thereby has a longer useful life.

In order to retain the sheet 12 in this folded form, specified contacting panels are adhered together by an epoxy or other adhesive. In particular, sides of the third intermediate panels 20*a* and 20*b* contact one another and are preferably adhered directly together. Optionally, sides of the first intermediate panels 16*a* and 16*b* and the contacting end panels 24*a* and 24*b*, respectively, are also adhered together. None of the other panel sides or contact points need be adhered to hold the rail together. Of course, the adhered panels can be attached together in other ways such as by staples, tape, straps, flaps and openings, a combination of these, or other fasteners or adherents. Also, panels in "contact" as used herein includes panels adjacent with only glue or another bonding agent therebetween.

Figure 3:
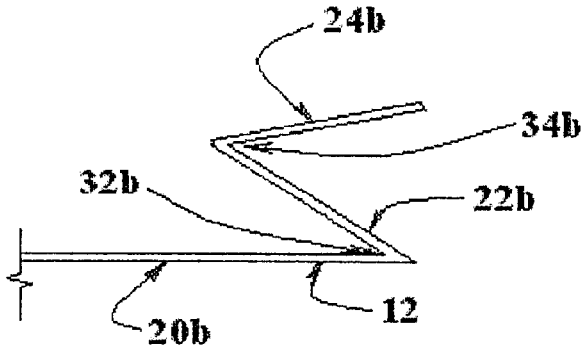
FIG. 3 is an end detail view of a portion of the sheet of FIG. 2, showing the reverse fold of one of the end panels.

Referring to FIGS. 2 and 3, the outward fold lines 34*a* and 34*b* connecting the end panels 34*a* and 34*b* to the fourth intermediate panels 32*a* and 32*b* are formed in the bottom side of the sheet 12. On the other hand, the inward fold lines 26*a*–32*b* of all the other panels are formed in the top (opposite) side of the sheet. In this way, only two folds are made against the prevailing fold direction, which allows for the use of a heavier gauge blank material, as compared to previously known corrugated paperboard rails. It will be understood that the fold lines can be produced by scoring, perforating, cutting, creasing, compressing, or otherwise creating a line, series of lines, or section for facilitating the folding of the panels.

Figure 4:
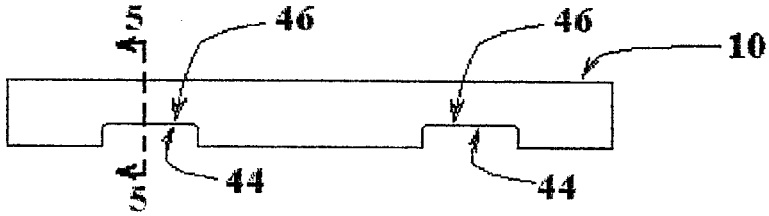
FIG. 4 is a side view of the rail of FIG. 1, showing the channel and the support portion.
Figure 5:
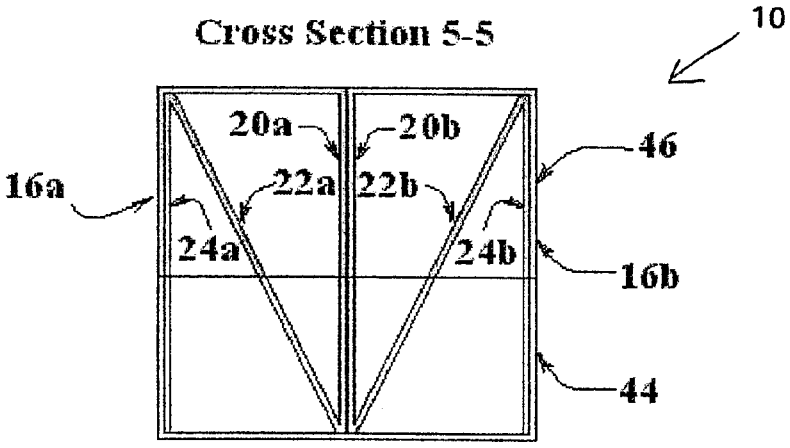
FIG. 5 is a sectional view of the rail taken at line 5—5 of FIG. 4, showing the channel and the support portion.

Referring to FIGS. 2, 4, and 5, the sheet 12 has two sets of openings, each set of openings including a central opening 38, two intermediate openings 40*a* and 40*b*, and two end openings 42*a* and 42*b*. The central opening 38 extends all the way across the central panel 14, and part but not all of the way across both first intermediate panels 16*a* and 16*b*. Each of the intermediate openings 40*a* and 40*b* extends part but not all of the way across one of the third intermediate panels 20*a* and 20*b* and one of the fourth intermediate panels 22*a* and 22*b*. Each of the end openings 42*a* and 42*b* extends part but not all of the way across one of the end panels 24*a* and 24*b*. In this way, when the sheet 12 is folded to form the rail 10, each set of openings aligns to form a transverse channel 44 through the rail, as seen best in FIG. 4.

For example, for a rail 10 used to make a pallet, the channels 44 are sized and shaped to receive the arms of a forklift. Such a pallet has four-way access for forklifts, that is, a forklift can approach and lift the pallet from any of the four sides of the pallet.

When approaching the pallet in the transverse direction, the forklift arms are inserted into the channels, or when approaching the pallet in the longitudinal direction, the forklift arms are inserted into the spaces between the rails. This arrangement is very useful in crowded warehouses where sometimes only one side of a pallet is exposed or accessible. Of course, only one set or more than two sets of openings can be provided for producing another number of channels as desired for a particular application.

Because the openings do not extend all the way across the panels (except the central panel 14 which forms the horizontal bottom of the rail 10), the rail 10 has a support portion 46 between each channel 44 and the top or opposite side of the rail, as shown in FIG. 4. Each support portion 46 includes a portion of each vertical first intermediate panel 16*a* and 16*b*, each vertical third intermediate panel 20*a* and 20*b*, each diagonal fourth intermediate panel 22*a* and 22*b*, and each vertical end panel 24*a* and 24*b*. In this way, the support portions 46 provide strength for supporting or withstanding the load that is applied to the rail 10 over the channels 44.

For example, when the rail is used in a pallet, the support portions 46 of the rail 10 absorb some of the load on the pallet. With previously known corrugated paperboard pallets, the forklift arms generally contact the underside of the pallet top sheet when the pallet is lifted, so the portion of the load not directly over one of the forklift arms is carried by the pallet top sheet. Therefore, previously known corrugated paperboard pallets often require relatively thick pallet top sheets, sometimes multi-layered or made of another construction, in order to support the load. On the other hand, the support portion 46 of the present rail 10 absorbs some of the load and distributes the load over the pallet top sheet and the rail, so that such heavy-duty pallet top sheets are not required.

Figure 6:
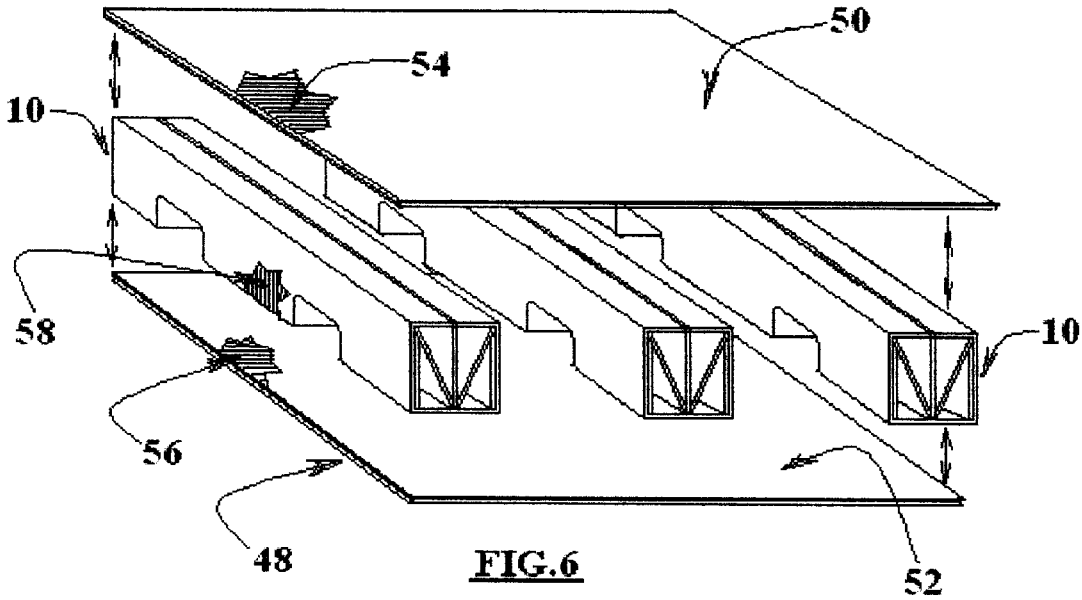
FIG. 6 is a perspective view of a pallet including three of the rails of FIG. 1.

FIG. 6 shows a pallet 48 comprising three rails 10, a top sheet 50, and a bottom sheet 52. The top and bottom sheets 50 and 52 are preferably corrugated paperboard or another sheet material. Also, the top and bottom sheets 50 and 52 are preferably oriented with their corrugation ribs 54 and 56 generally perpendicular to lengthwise direction of the rails 10, thereby providing a high strength pallet. The rails 10 preferably have a transverse corrugation orientation, with their corrugation ribs 58 generally perpendicular to the length of the rail. Alternatively, the rails 10 have a longitudinal corrugation orientation, with their corrugation ribs generally parallel to the length of the rail; and the top and bottom sheets 50, 52 have their corrugation ribs oriented generally parallel to the length of the rails 10. As used herein, "longitudinal" means along the length of the rail including when referring to the top and bottom sheets, and "transverse" means across width of the rail.

Figure 7:
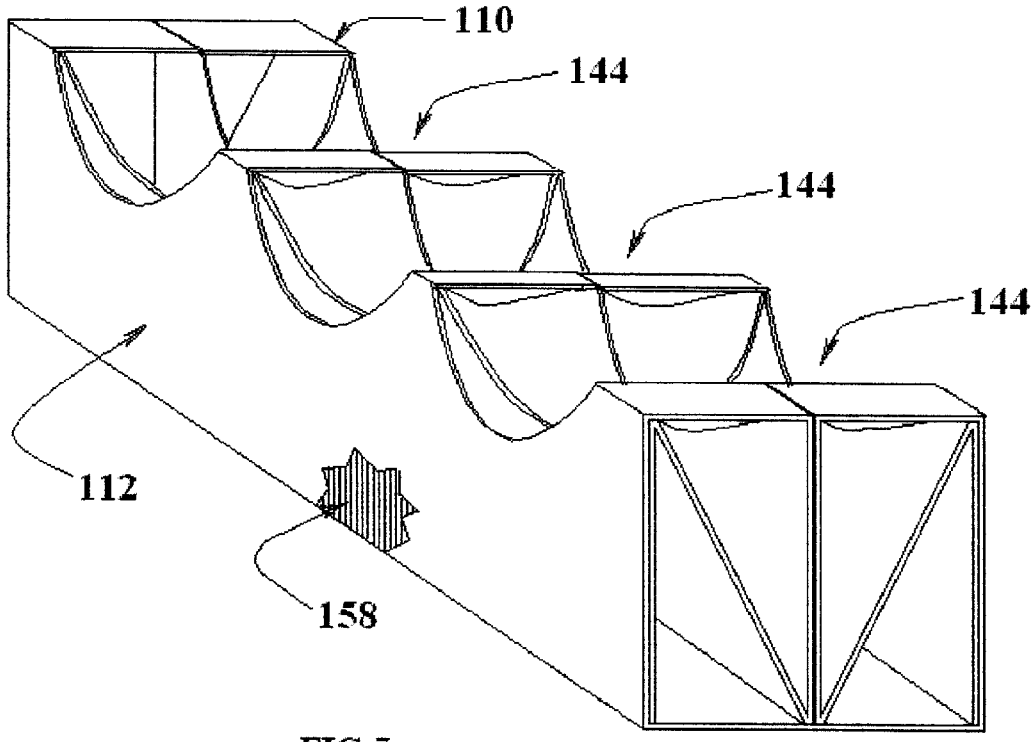
FIG. 7 is a perspective view of a rail of a second exemplary embodiment of the present invention, showing the rail with three channels.

Referring now to FIG. 7, there is illustrated a second exemplary embodiment of the present invention, referred to generally as the cradle rail 110. The cradle rail 110 is similar to the rail 10 of the first embodiment and is similarly formed from a blank or sheet 112 with a plurality of panels interconnected by fold lines. In the depicted embodiment, the cradle rail 110 has three transverse channels 144 formed therein for cradling three cylindrical products (or three parts of one product). Also, the cradle rail 110 preferably has transverse corrugation ribs 158. In this way, the cradle rail 110 can be used to protect the items supported thereby from damage due to accidental shifting, dropping or rolling during transport and storage. The channels 144 can be provided in any quantity and shape desired, including the semicircular channels shown, or square, polygonal, or other regular or irregular shapes, by forming the corresponding openings in the sheet 112, in a manner similar to the openings 38, 40, 42 formed in blank 12 described above.

Referring now to FIG. 8, there is illustrated a third exemplary embodiment of the present invention, referred to generally as the solid rail 210. The solid rail 210 is similar to the rail 10 of the first embodiment and is similarly formed from a blank or sheet 212 with a plurality of panels interconnected by fold lines. The blank 212 used to form the solid rail 210 does not include openings 38, 40, 42, but otherwise is substantially the same as blank 12, described above, and the folding sequence is also substantially as described above. The solid rail 210 does not have any channels formed therein, so the solid rail is well suited for applications requiring the highest possible strength for withstanding a load. As such, the solid rail 212 can be used in a pallet, as a brace or divider in packaging, or in other applications.

Referring now to FIG. 9, there is illustrated a fourth exemplary embodiment of the present invention, referred to generally as the corner post rail 310. The corner post rail 310 is similar to the rail 210 of the third embodiment and is similarly formed from a blank or sheet 312 with a plurality of panels interconnected by fold lines. The corner post rail 310 has two central panels 314*a* and 314*b* attached by a fold line 325. Thus, it will be understood that the corner post rail 310 is fabricated in substantially the same way as the general rail 10 described above, with several minor modifications. First, the central panel 14 of the blank is divided approximately midway along its width by an additional score line to form fold line 325, and need not include openings 38, 40, 42. In addition, after the rail is folded as described above for the rail 10, fabrication of the corner post rail 310 requires an additional outward fold along fold line 325. The third intermediate panels are not adhered together in forming the corner post rail 310.

In this configuration, the corner post rail 310 comprises two rail sections 360*a* and 360*b* each including one of the central panels, four of the intermediate panels, and one of the end panels. The rail sections 360*a* and 360*b* form an angle with respect to one another, for example, at about ninety degrees. Also, the corner post rail 310 preferably has longitudinal corrugation ribs 358. The corner post rail 310 then can be used as an upright post with greater compression strength. For example, corner post rail 310 can be used as a vertical post in the corner of a carton or other package to protect the contents of the carton from crushing when stacked. Furthermore, the corner post rail 310 can be used as a cushion to protect the contents of the carton from impacts on two sides and the corner.

Referring now to FIG. 10, there is illustrated a fifth exemplary embodiment of the present invention, referred to generally as the cushioning rail 410. The cushioning rail 410 is similar to the corner post rail 310 of the fourth embodiment and has two angled rail sections 460*a* and 460*b*, similarly formed from a sheet 412 with a plurality of panels interconnected by fold lines. The cushioning rail 410 preferably has transverse corrugation ribs 458, as opposed to the longitudinal corrugation ribs 358 of the corner post rail 310. In this way, the cushioning rail 410 can be used as a corner protector for absorbing side impacts and creating a cushion space to protect the contents of the carton from side and corner impacts.

Figure 11:
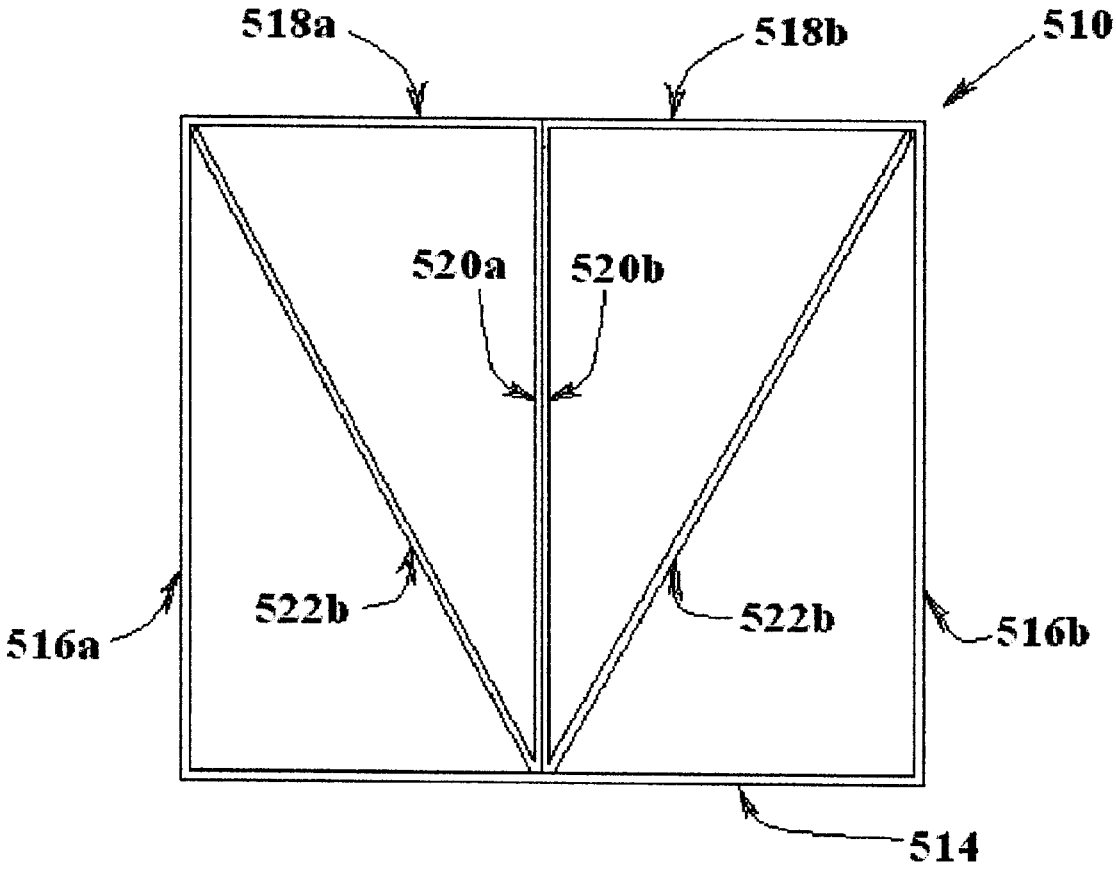
FIG. 11 is a sectional end view of a rail of a sixth exemplary embodiment of the present invention, showing the rail formed by a folded sheet without the end panels of the previous embodiments.

Referring now to FIG. 11, there is illustrated a sixth exemplary embodiment of the present invention, referred to generally as the alternative rail 510. The alternative rail 510 is similar to the general rail 10 of the first embodiment and is similarly formed from a blank or sheet 512 with a plurality of panels interconnected by fold lines. In the depicted embodiment, the alternative rail 510 has a central panel 514, two first intermediate panels 516*a* and 516*b*, two second intermediate panels 518*a* and 518*b*, two third intermediate panels 520*a* and 520*b*, and two fourth intermediate panels 522*a* and 522*b*, but does not include the end panels of the previous embodiments. The third panels 520*a* and 520*b* are adhered together by glue or another bonding substance sufficient to retain the rail in the folded shape. In this arrangement, the alternative rail 512 is not as strong as several of the previous embodiments, but for some applications such greater strength is not needed. Advantageously, the alternative rail 512 can be assembled with fewer folding steps and less material, thereby providing the appropriate strength for some applications, at a lower cost and weight.

Accordingly, the present invention has a number of benefits over the prior art.

The rail has six (or fewer) generally vertical panels and two diagonal panels for providing high weight-bearing strength and impact-resistance with a minimum of material and assembly steps. Also, the panels are arranged so that only three (or fewer) glue areas are used for adhering panels together. Additionally, in specified embodiments, the rail has channels and support portions formed by openings particularly positioned in the sheet for increased strength and distribution of load when lifting a pallet made with the rails. Furthermore, the rail can be provided in several different forms, including with an additional fold line for folding into two rail sections for use as a corner post or cushion for protecting the contents of cartons during shipping and storage.

While the invention has been disclosed in several preferred forms, it will be apparent to those skilled in the art that many modifications, additions, and deletions can be made therein without departing from the spirit and scope of the invention as set forth in the following claims.

I claim:

1. A rail for withstanding a load and formed from a folded sheet, said sheet comprising:

a) a central panel;

b) two first intermediate panels each inwardly folded and extending generally perpendicularly from said central panel in a generally vertical orientation;

c) two second intermediate panels each inwardly folded and extending generally perpendicularly from one of said first intermediate panels in a generally horizontal orientation;

d) two third intermediate panels each inwardly folded and extending generally perpendicularly from one of said second intermediate panels in a generally vertical orientation, wherein said third intermediate panels contact each other and form a third generally vertically disposed double wall;

e) two fourth intermediate panels each inwardly folded and extending diagonally from one of said third intermediate panels; and f) two end panels each outwardly folded and extending from one of said fourth intermediate panels in parallel with one of said first intermediate panels in a generally vertical orientation, wherein said end panels and said first intermediate panels contact each other and form first and second exterior generally vertically disposed double walls, wherein each of said end panels forming said first and second double walls abut and are prevented from laterally moving by said central panel;

wherein other than said two first intermediate panels, said two third intermediate panels, and said two end panels, no other panels are vertically disposed.

2. The rail of claim 1, wherein said outward folding of said end panels with respect to said adjacent intermediate panels is in one direction and said inward folding of all other of said panels is in an opposite direction.

3. The rail of claim 1, wherein said central panel, said first intermediate panels, and said second intermediate panels are folded to form said rail into a generally rectangular cross-sectional shape with a generally rectangular periphery defining an inner space, and each of said end panels has an open edge that is disposed within said inner space.

4. The rail of claim 1, defining one or more transverse channels, each formed by a plurality of openings defined in said sheet and aligned when said sheet is folded to form said rail, said openings in said sheet including a central opening defined in said central panel and each of said first intermediate panels, an intermediate opening defined in each of said third and fourth intermediate panels, and an end opening defined in each of said end panels.

5. The rail of claim 4, wherein said central opening extends all the way across said central panel and part but not all of the way across each first intermediate panel, each intermediate opening extends part but not all of the way across one of said third and fourth intermediate panels, and each end opening extends part but not all of the way across one of said end panels, so that when said sheet Is folded to form said rail, a portion of said vertically disposed intermediate panels, said diagonally disposed intermediate panels, and said vertically disposed end panels remains between said channel and an opposite side of said rail.

6. The rail of claim 4, wherein said channels comprise two channels each sized to receive an arm of a forklift therein.

7. A pallet for supporting a load, comprising:

a) two or more rails each formed by a rail sheet having:

i. a central panel;

ii. two first intermediate panels each inwardly folded and extending generally perpendicularly from said central panel in a generally vertical orientation;

iii. two second intermediate panels each inwardly folded and extending generally perpendicularly from one of said first intermediate panels in a generally horizontal orientation;

iv. two third intermediate panels each inwardly folded and extending generally perpendicularly from one of said second intermediate panels in a generally vertical orientation, wherein said third intermediate panels contact each other and form a third generally vertically disposed double wall, v. two fourth intermediate panels each inwardly folded and extending diagonally from one of said third intermediate panels; and vi. two end panels each outwardly folded and extending from one of said fourth intermediate panels in parallel with one of said first intermediate panels in a generally vertical orientation, wherein said end panels and said first intermediate panels contact each other and form first and second exterior generally vertically disposed double walls, wherein each of said end panels forming said first and second double walls abut and are prevented from laterally moving by said central panel, wherein other than said two first intermediate panels, said two third intermediate panels, and said two end panels, no other panels are vertically disposed; and b) a top sheet supported on a top surface of said rails.

8. The pallet of claim 7, wherein said central panel, said first intermediate panels, and said second intermediate panels are folded to form said rail into a generally rectangular cross-sectional shape with a generally rectangular periphery defining an inner space, and each of said end panels has an open edge that is disposed within said inner space.

9. The pallet of claim 3, further comprising two or more channels defined transversely through each of said rails, each of said channels formed by a plurality of openings defined in said rail sheet and aligned when said sheet is folded to form said rail, said openings in said sheet including a central opening defined in said central panel and said two adjacent intermediate panels, an intermediate opening defined in two of said intermediate panels, and an end opening defined in each of said end panels.

10. The pallet of claim 9, wherein said central opening extends all the way across said central panel and part but not all of the way across each adjacent intermediate panel, said intermediate opening extends part but not all of the way across each of said two corresponding intermediate panels, and each end opening extends part but not all of the way across one of said end panels, so that when said sheet is folded to form said rail, a portion of said vertically disposed intermediate panels, diagonally disposed intermediate panels, and vertically disposed end panels remains between said channel and an opposite side of said rail.

11. The pallet of claim 9, wherein said channels comprise two channels each sized to receive an arm of a forklift therein.

12. The pallet of claim 7, wherein said top sheet comprises corrugated paperboard having a transverse corrugation orientation.

13. A sheet for folding into a rail for withstanding a load, the sheet comprising:

a) a central panel;

b) two first intermediate panels each attached to said central panel by an inward fold line for folding said first intermediate panels to a generally vertical orientation;

c) two second intermediate panels each attached to one of said first intermediate panels by an inward fold line for folding said second intermediate panels to a generally horizontal orientation;

d) two third intermediate panels each attached to one of said second intermediate panels by an inward fold line for folding said third intermediate panels to a generally vertical orientation, wherein said third intermediate panels contact each other and form a third generally vertically disposed double wall;

e) two fourth intermediate panels each attached to one of said third intermediate panels by an inward fold line for folding said fourth intermediate panels to a diagonal orientation relative to said third intermediate panels; and f) two end panels each attached to one of said fourth intermediate panels by an outward fold line formed in an opposite side of said sheet relative to said inward fold lines for folding said end panels to a generally vertical orientation, wherein said end panels and said first intermediate panels contact each other and form first and second exterior generally vertically disposed double walls, wherein each of said end panels forming said first and second double walls abut and are held in position by said central panel, wherein other than said two first intermediate panels, said two third intermediate panels, and said two end panels, no other panels are vertically disposed.

14. The sheet of claim 13, wherein said outward fold lines between said end panels and said fourth intermediate panels are formed on one side of said sheet and said inward fold lines of all other of said panels are formed on an opposite side of said sheet.

15. The sheet of claim 13, wherein said sheet has a plurality of openings defined therein, with said openings including one or more central openings each defined in said central panel and each of said first intermediate panels, one or more intermediate openings each defined in one of said third and fourth intermediate panels, and one or more end openings each defined in one of said end panels.

16. The sheet of claim 15, wherein each central opening extends all the way across said central panel and part but not all of the way across each first intermediate panel, each intermediate opening extends part but not all of the way across one of said third and fourth intermediate panels, and each end opening extends part but not all of the way across one of said end panels.

17. A corner rail for withstanding a load, comprising:

a single sheet having a first central panel, a first end panel, and a first set of intermediate panels folded to form a first rail section, and having a second central panel, a second end panel, and a second set of intermediate panels folded to form a second rail section, said first and second rail sections formed from said single sheet and angled with respect to each other to receive a corner of an object, each panel having two sides, each of said end panels generally perpendicularly disposed relative to said corresponding central panel and with one side of each end panel contacting one of said intermediate panel sides to form two exterior double walls, wherein each of said end panels forming said double walls abut and are prevented from laterally moving by said central panel, with one other of said intermediate panels generally perpendicularly disposed relative to said corresponding central panel, with one other of said intermediate panels generally diagonally disposed, and with no other panel sides contacting.

18. The rail of claim 17, wherein said end panels are folded with respect to said adjacent intermediate panels In a first direction, said central panels are folded with respect to each other in said first direction, and all other of said intermediate panels are folded in a second direction that is opposite to said first direction.

19. The rail of claim 17, wherein said central panel and three of said intermediate panels of each rail section form a generally rectangular cross-sectional rail shape with a periphery defining an inner space, and said end panel of each rail section has an open edge that is disposed within said corresponding inner space.

20. The rail of claim 17, wherein said rail sections are disposed with respect to each other at an angle of about ninety degrees.

* * * * *